US007626103B1

(12) United States Patent
Phillips

(10) Patent No.: US 7,626,103 B1
(45) Date of Patent: Dec. 1, 2009

(54) MUSICAL INSTRUMENT PICK HOLDER

(75) Inventor: John Martin Phillips, Carson City, NV (US)

(73) Assignee: William A. Phillips, Kalispell, MT (US)

( * ) Notice: Subject to any disclaimer, the term of this patent is extended or adjusted under 35 U.S.C. 154(b) by 0 days.

(21) Appl. No.: 12/025,225

(22) Filed: Feb. 4, 2008

Related U.S. Application Data

(60) Provisional application No. 60/888,448, filed on Feb. 6, 2007.

(51) Int. Cl.
*G10D 3/16* (2006.01)

(52) U.S. Cl. ..... 84/320

(58) Field of Classification Search ..... 84/320–322, 84/327, 329

See application file for complete search history.

(56) References Cited

U.S. PATENT DOCUMENTS 4,890,531 A * 1/1990 Tischer ..... 84/329
5,905,217 A * 5/1999 Byers ..... 84/322

OTHER PUBLICATIONS

Dunlop "Picker's Pouch" Pick Holder Key Chain, http://www.earfloss.com/gifts/2300235_alt_gf.html, 1 page, printed Dec. 13, 2007.

The Music Stand Guitar Pick Holder/Key Chain, http://www.ship.com/Guitar_Pick_Holder_Key_Chain-35221929-46428371-p!.shtml?so..., 1 page, printed Dec. 13, 2007.

Google search results for search terms "jim dunlop pick holder", http:/www.google.com/product?hl=en&resnum=0 &q=jim+dunlop+pick+holder&um=1..., 2 page, printed Nov. 2, 2007.

Dickies Pick Pocket at DV247.COM, http://www.dv247.com/invt/35192/, 1 page, printed Nov. 2, 2007.

Quick Release Pick Necklace from "Your Favorite Musician", http://www.musiciansfriend.com/gifts, 1 page, date unknown.

* cited by examiner

*Primary Examiner*—Kimberly R Lockett
(74) *Attorney, Agent, or Firm*—Lewis and Roca LLP

(57) ABSTRACT

A musical instrument pick holder that provides convenient temporary storage of one or more picks. The pick holder provides a housing that is the same or substantially the same shape as the pick. The pick holder stores one or more picks therein and provides for quick and easy access to the picks. The pick holder has an internal biasing member that releasably retains the picks therein. The pick holder further provides one or more exterior surfaces that are suitable for placement of advertising or marketing indicia or graphical elements. The pick holder further comprises a key ring or other clasping element for releasable coupling with another items such as the garment of a musician.

12 Claims, 2 Drawing Sheets

MUSICAL INSTRUMENT PICK HOLDER

CROSS REFERENCE TO RELATED APPLICATIONS

The present application claims the benefit of co-pending U.S. Provisional Application Ser. No. 60/888,448, filed Feb. 6, 2007, which is incorporated by reference herein in its entirety.

FIELD OF THE INVENTION

The present invention relates to guitar pick holders. More particularly, this invention relates to a holder for storing guitar picks having a rigid housing that may be affixed to an everyday item such as a key ring for convenient handling of the picks.

BACKGROUND OF THE INVENTION

Many players of stringed instruments, such as guitars and banjos, use a pick to strum the chords while playing. Picks are generally, a small piece of plastic, wood, or other rigid material that are relatively thin and flat. Typically, picks are also substantially shaped as triangles to allow more control while strumming.

In the past, several attempts have been made to conveniently store a musical instrument pick. Firstly, musicians have stored picks by placing the pick under the cords of the instrument along the neck or other region of the instrument. This approach is problematic for a few reasons. Placing the pick along the neck and in-between the cords can loosen the cords. Loosening the cords will cause the stringed instrument to become detuned and unable to deliver quality sound. Further, the cords are not optimal for retaining the pick therein and the pick frequently becomes loose and falls out from between the cords.

Secondly, another attempt to conveniently store a pick utilizes as case or pouch to retain one or more picks therein. However, the case/pouch is not an ideal solution as the picks are small and can become unorganized inside a case. Moreover, the case or pouch requires the musician to open and rummage through the pouch to find and acquired the desired pick.

Thirdly, several dispensers have been developed that adhere or affix to the musical instrument. This approach while somewhat useful, requires that the musician alter or modify the instrument. The modification may be problematic from both a functional and aesthetic aspect. Further, musicians are hesitant to modify a preferred instrument because the appearance and playability of the instrument may be adversely effected. Generally, these dispenser-type pick holders are secured to the surface of the instrument by way of an adhesive applied to the back surface of the dispenser. The adhesive is then coupled with the surface of the instrument. However, when the musician desires to relocate or remove the dispenser, residual adhesive has to be removed from the surface of the instrument. The removal of various adhesives can be laborious and time consuming as well as increasing the probability of damaging the surface finish of the instrument.

Finally, another attempt to provide a convenient means for storing one or more musical instrument picks uses a rubber or plastic rail that is mounted to a microphone stand. The rail has a slot, groove, or elongate clip, which retains the picks therein. While somewhat useful, this pick holder requires that the musician stay near the microphone stand to have access to the picks. Further, when the musician is playing near the stand, the multitude of picks retained by the rail is unsightly as it detracts and blocks the visual appearance of the musician.

Efforts to provide convenient and easy access to musical picks have not met with much success to date. Correspondingly, those skilled in the art acknowledge there is a need for a new type of pick holder that overcomes the previously discussed deficiencies.

SUMMARY OF THE INVENTION

The above and other problems are solved and an advance in the art is made by a pick holder in accordance with the present invention. A pick holder in accordance with this invention provides a rigid structure for storing at least one pick therein. Secondly, a pick holder may be affixable to other objects to allow a user to easily access the holder.

In one embodiment the pick holder for storing at least one pick for a musical instrument has a housing having a top surface, an opposing bottom surface, a first end and an opposing second end. The top and bottom surfaces are configured in a spaced-apart relationship defining an interior cavity therebetween. The housing is further configured to substantially match the perimeter profile of at least one pick. The second end of the housing has an opening for inserting and removing at least one pick. The pick holder has an aperture formed adjacent the first end where the aperture extends from the top surface through the bottom surface. The pick holder also has a biasing member coupled to the bottom surface and positioned within the internal cavity. The biasing member is configured to releasably retain at least one pick within the internal cavity.

In alternate embodiments, the pick holder is configured to have a coupling device passing through the aperture such as a key ring. The pick holder may also be configured with an external surface having an indicia or graphical element associated therewith. The number of picks stored within the pick holder may be defined by the space-apart relationship and the size of the interior cavity.

For a fuller understanding of the nature and advantages of the present invention, reference should be made to the ensuing detailed description and claims, taken in conjunction with the accompanying drawings.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF THE INVENTION

The present invention provides a convenient and readily accessible device for storing one or more musical instrument picks. In the following description, numerous specific details are set forth in order to provide a more thorough description of the present invention. It will be apparent, however, to one skilled in the art, that the present invention may be practiced without these specific details. Other embodiments of the invention will readily suggest themselves to such skilled persons having the benefit of this disclosure. In some instances, well-known features have not been described in detail so as not to obscure the invention.

Figure 1:
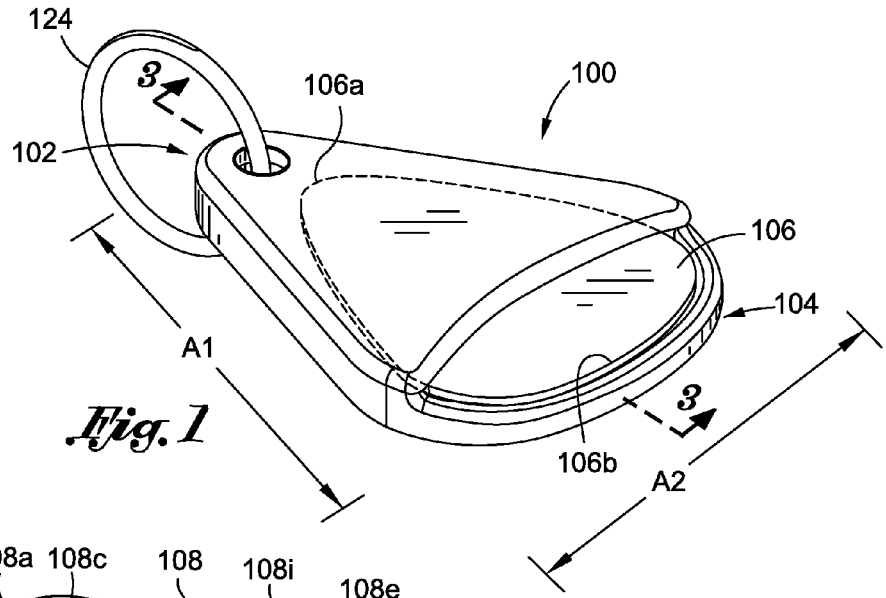
FIG. 1 is an isometric view of a musical instrument pick holder in accordance with the present invention.
Figure 2:
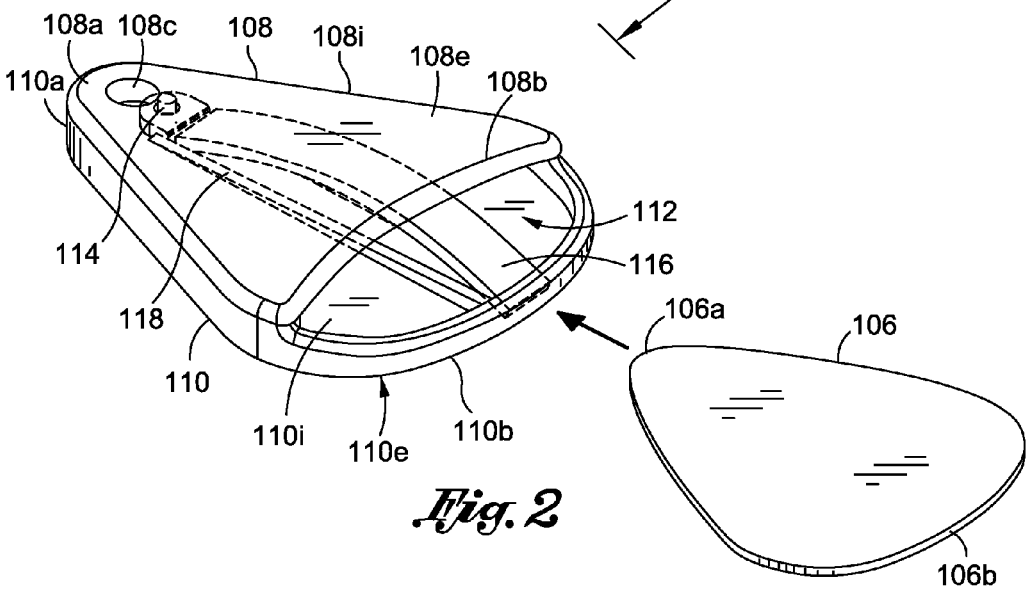
FIG. 2 is an isometric view of the pick holder of FIG. 1 showing the insertion of a pick therein.

Reference is now made to FIGS. 1 and 2, which illustrate isometric views of a musical instrument pick holder 100 in accordance with the present invention. Pick holder 100 generally comprises a rigid housing having a first end 102 and a pick insertion end 104. The pick holder 100 has a longitudinal axis A1 and a latitudinal axis A2. In one exemplary embodiment, A1 is approximately 1.5" and A2 is approximately 1". However one of ordinary skill in the art having the benefit of this disclosure will readily appreciate that other suitable dimensions for A1 and A2 can be utilized as desired. Pick holder 100 is formed and configured to have the same or substantially similar contour or shape as the perimeter profile of a pick 106. As illustrated in FIG. 1, the pick 106 is releasably retained within the pick holder 100. The pick 106 has a first end 106*a* and a second end 106*b*.

Attention is now directed to FIG. 2, which illustrates the pick holder 100 with the pick 106 removed therefrom. Pick holder 100 comprises an upper member 108 and a base member 110. The upper member 108 has a first end 108*a*, a second end 108*b*, an external surface 108*e* and an opposing internal surface 108*i*. The base member 110 has a first end 110*a*, a second end 110*b*, and external surface 110*e* and an opposing internal surface 110*i*. The upper member 108 and base member 110 are positioned in a spaced apart relation such that an internal cavity 112 is formed therebetween (i.e., between the internal surface 108*i* and internal surface 110*i* of the upper member 108 and base member 110 respectively). The internal cavity 112 is sized and configured to releasably retain one or more pick(s) 106 therein.

The upper member 108 is shaped to have a substantially similar contour as the forward portion of pick 106 and has an elongated first end 108*a* that extends beyond the first end 106*a* of the pick 106. Adjacent to the elongated first end 108*a* is a hole 108*c* that is formed through the upper member 108. The second end 108*b* of the upper member 108, is contoured to permit access to the second end 106*b* of the pick 106, when a pick 106 is inserted into the internal cavity 112. In one illustrative embodiment, the upper member 108 partially extends from the first end 106*a* towards the second end 106*b* of the pick 106. The second end 108*b* of the upper member 108 is curved such that second end 106*b* of the pick 106 is exposed (see FIGS. 1 and 2). Since, upper member 108 only partial covers the pick 106 inserted therein, an opening 109 is formed that provides tactile access to the pick 106 (see FIG. 3).

Base member 110 is shaped to have the same or substantially similar contour as the pick 106 and has an elongated first end 110*a* that extends beyond the first end 106*a* of the pick 106. Adjacent to the elongated first end 110*a* is a hole 110*c* that is formed through the base member 110. The hole 110*c* of the base member 110 is axially aligned with the hole 108*c* of the upper member 108, (see FIG. 3). The second end 110*b* of the base member 110 has a contour that substantially follows the second end 106*b* of the pick 106.

A boss 114 extends from the inner surface 110*i* of the base member 110 towards the inner surface 108*i* of the upper member 108. By "inner surface" it is meant the interior surfaces forming the internal cavity 112 created between the upper member 108 and the base member 110. The boss 114 is sized for operative insertion into a mating portion of a retention spring 116.

Figure 3:
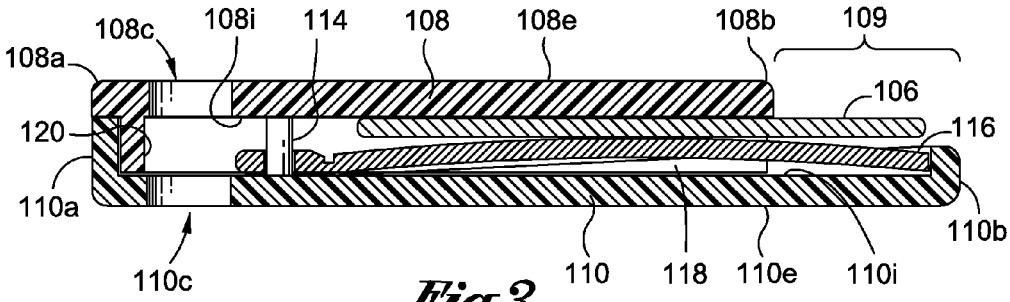
FIG. 3 is a cross-sectional view of the musical instrument pick holder of FIG. 1 taken along section line 3-3.

Retention spring 116 has a first end 116*a* and a second end 116*b*. Integrally formed on the first end 116*a* of retention spring 116 is an aperture 116*c* (see FIG. 4) that operatively mates with the boss 114 of the base member which positionally secures the retention spring 116 with respect to the base member 110. Retention spring 116 is substantially aligned with the longitudinal axis A1. The retention spring 116 provides a biasing force that releasably retains one or more picks 106 within the internal cavity 112 of the pick holder 100. As illustrated in FIG. 3, the retention spring 116 biases one or more pick(s) 106 towards the inner surface 108*i* of the upper member 108. The retention spring 116 may be configured or fabricated from any suitable material such as polymers, metals, spring steels, fiber re-enforced resins and combinations thereof. The retention spring 116 is captured between the upper member 108 and the base member 110 and is constrained by the boss 114 and one or more retention flanges 118. Retention flanges 118 prevent the retention spring 116 from pivoting within the internal cavity 112 and thus provide consistent positioning of the retention spring 116.

In one illustrative embodiment, retention spring 116 comprises a curved elongate member generally extending from the first end 102 towards the second end 104 of the pick holder 100. The retention spring 116 provides both a biasing force and a guiding surface that facilitates insertion and removal of a pick 106 from within the pick holder 100.

Figure 4:
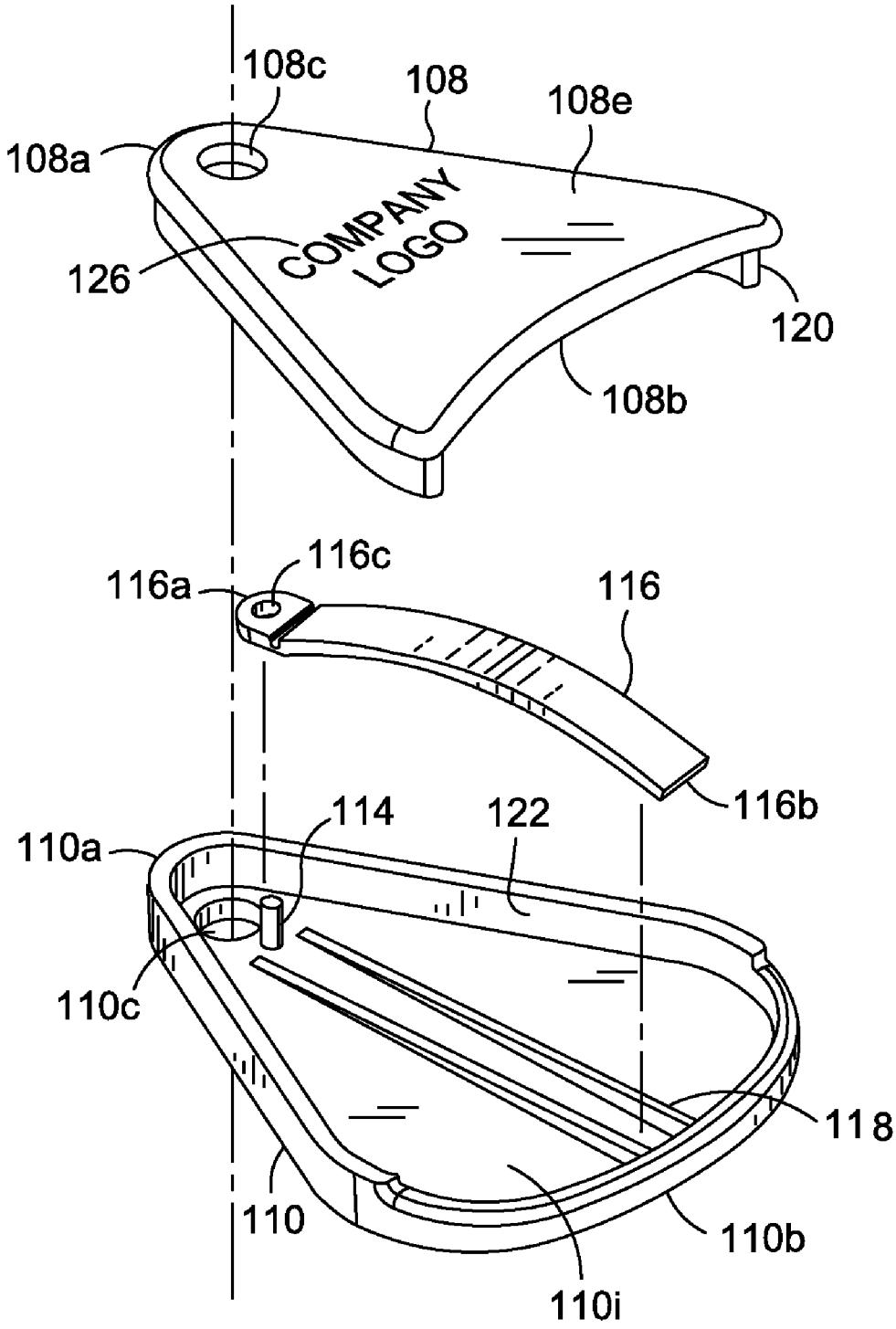
FIG. 4 is an exploded isometric view of the pick holder in accordance with one embodiment of the present invention.

Reference is now made to FIGS. 3 and 4 in combination, in which upper member 108 is configured with a sidewall 120 that protrudes from the inner surface 108*i* towards the inner surface 110*i* of the base member 110. The sidewall 120 substantially follows the perimeter of the upper member 108 (see FIG. 4) and functions as a spacer to facilitate the spaced-apart relationship between the upper member 108 and the base member 110. In one exemplary embodiment, the sidewall 120 is approximately 5/32" in height. However one of ordinary skill in the art having the benefit of this disclosure will readily appreciate that other suitable heights can be utilized as desired.

Directing attention to FIG. 4, base member 110 has a sidewall 122 that extends from the exterior surface 110*e* towards the interior surface 108*i* of the upper member 108. The sidewall 122 of the base member 110 substantially follows the perimeter of the base member 110. The sidewall 120 of the upper member 108 is sized and configured for insertion within the sidewall 122 of the base member 110 such that an internal cavity 112 is formed in the pick holder 100. The height of the sidewalls 120 and 122 define the capacity of the internal cavity 112 which directly corresponds to the number of picks 106 that can be stored within the pick holder 100. The upper member 108 may be coupled to the base member 110 by one of many now known or later developed methods or fastening means such as, gluing, snap-connectors, press-fit connection, frictional fit, ultra-sonic welding, epoxies, resins, mechanical fasteners (screws, pins or rivets) or combinations thereof.

In one exemplary embodiment, the holes 108*c* and 110*c* form an aperture that accepts a key ring 124 or other coupling device for holding, attaching or coupling the pick holder 100 to an external element or other item such as a garment or set of keys. Key ring 124 may be a conventional split-ring or other type of ring for releasable coupling with another item. It is contemplated that the other coupling devices may be a clip, clasp, hook, or other device capable of releasable coupling between two elements.

In another illustrative embodiment, the external surfaces 108*e* and 110*e* of the pick holder 100 are configured to receive one or more indicia or graphical elements 126 thereon or integrally formed therein. For example, the graphical elements 126 may be a company or band logo. The indicia or graphical elements 126 generally convey data, information or other impressions to an observer or user of the pick holder 100. By way of example, the external surfaces may be configured to incorporate a company logo, band name or trademark. In another example, the external surfaces may be coupled with a sicker or emblem for advertising or marketing purposes. As such, the external surfaces transform into advertising or messaging placards that are associated with the pick holder 100.

The upper member 108, base member 110 and retention spring 116 may be fabricated from several known types of materials. Some examples of suitable construction materials are: thermoplastic sheet, thermoformed polymers, thermoset polymers, fiber reinforced composites, metals, alloys, plastics, epoxies or resins. The construction material should provide high strength, durability, resiliency and combinations thereof. Correspondingly, there are several known manufacturing processes that are suitable to produce the structures of the present invention. Some examples of various processes are: injection molding, thermal forming, vacuum forming, composite lay-up, casting or machining. These manufacturing processes are well known and not described in detail so as not to obscure the invention.

The pick holder invention disclosed herein provides several advantages not found in known pick holder devices. Firstly, the invention enables the musician to store one or more picks without interfering with the performance of the musical instrument (i.e., does not affect the tuning of the instrument). Secondly, the invention provides a very simple device that conveniently stores picks that are readily accessible to the musician. Thirdly, the invention provides a storage device that does not adhere to the musical instrument and thus will not harm the surface of the instrument. Finally, the invention does not obstruct or adversely interfere with the musician's performance. Consequently, the invention provides a cost effective, convenient and easy to use holder for musical instrument picks.

Although the above provides a full and complete disclosure of the preferred embodiments of the invention, various modifications, alternate constructions and equivalents will occur to those skilled in the art. For example, the pick holder may be configured with various biasing mechanisms that releasably retain one or more picks. Also the pick holder may be constructed as a unitary device that combines the upper member and base member into a one-piece housing. Additionally, the aesthetic appearance of the invention may be altered to provide an enhanced fashionable statement such as by incorporating various embellishments like carved exterior surfaces, elaborate contouring or color combinations. Therefore, the disclosure should not be construed as limiting the invention, which is defined by the claims.

I claim:

1. An apparatus for storing at least one pick for a musical instrument comprising:

a housing having a top surface, an opposing bottom surface, a first end and an opposing second end, the top and bottom surfaces configured in a spaced-apart relationship defining an interior cavity therebetween, the housing further configured to substantially match the perimeter profile of the at least one pick, the second end having an opening for inserting and removing the at least one pick;

an aperture formed adjacent the first end, the aperture extending from the top surface through the bottom surface; and a biasing member coupled to the bottom surface and positioned within the internal cavity, the biasing member configured to releasably retain the at least one pick within the internal cavity.

2. The apparatus in accordance with claim 1, further comprising a coupling device passing through the aperture.

3. The apparatus in accordance with claim 2, wherein the coupling device comprises a key ring.

4. The apparatus in accordance with claim 2, wherein the coupling device comprises a clip.

5. The apparatus in accordance with claim 1, wherein the top surface comprises an external surface configured with at least one indicia.

6. The apparatus in accordance with claim 1, wherein the bottom surface comprises an external surface configured with at least one indicia.

7. The apparatus in accordance with claim 1, wherein the housing comprises at least one external surface having at least one indicia.

8. The apparatus in accordance with claim 1, wherein the housing is constructed from an assembly comprising an upper member and a base member, wherein the upper member and base member fit together in a spaced-apart relationship defined by a plurality of sidewalls.

9. The apparatus in accordance with claim 8, wherein the upper member and base member are coupled together using an attachment means.

10. The apparatus in accordance with claim 9, wherein the attachment means is selected from the group consisting of gluing, press-fit connecting, sonic welding or mechanical fasting.

11. The apparatus in accordance with claim 8, wherein the plurality of sidewalls define a capacity of the internal cavity, wherein the capacity defines the number of picks that can be stored in the housing.

12. The apparatus in accordance with claim 8, wherein the upper member comprises a first end and an opposing second end, the second end configured with a curved edge to facilitate insertion and removal of the at least one pick.

* * * * *